US005522222A

United States Patent [19]

Kwon

[11] Patent Number: 5,522,222

[45] Date of Patent: Jun. 4, 1996

[54] COOLING AND HEATING SYSTEM UTILIZING A VUILLEUMIER PUMP

[75] Inventor: Yong R. Kwon, Seoul, Rep. of Korea

[73] Assignee: Samsung Electronics Co., Ltd., Suwon, Rep. of Korea

[21] Appl. No.: 249,207

[22] Filed: May 26, 1994

[30] Foreign Application Priority Data

Jun. 10, 1993 [KR] Rep. of Korea ..... 93-10516

[51] Int. Cl.[6] ..... F25B 9/00

[52] U.S. Cl. ..... 62/6; 62/324.1

[58] Field of Search ..... 62/6, 324.1

[56] References Cited

U.S. PATENT DOCUMENTS 4,969,333 11/1990 Osawa et al. ..... 62/6

FOREIGN PATENT DOCUMENTS 4-24474 1/1992 Japan .

*Primary Examiner*—Ronald C. Capossela

*Attorney, Agent, or Firm*—Burns, Doane, Swecker & Mathis

[57] ABSTRACT

A cooling and heating system includes a hot water tank having a hot water heat exchanger, an indoor heat exchanging assembly including first and second indoor heat exchangers, an outdoor heat exchanger, and a vuilleumier heat pump. Fluid medium from a high temperature side of the heat pump is circulated to the hot water heat exchanger in both the heating and cooling modes. In the heating mode, fluid medium exiting the hot water heat exchanger travels through the first indoor heat exchanger. In the cooling mode, fluid medium is circulated through the hot water heat exchanger and then back to the heat pump while simultaneously fluid medium from the low temperature side of the heat pump is circulated through the second indoor heat exchanger. During a hot water heating mode, fluid medium from the high temperature side of the heat pump is circulated through the hot water heat exchanger without being circulated through the indoor heat exchanging assembly.

9 Claims, 2 Drawing Sheets

COOLING AND HEATING SYSTEM UTILIZING A VUILLEUMIER PUMP

FIELD OF THE INVENTION

The present invention relates to a cooling and heating system using a vuilleumier heat pump.

DESCRIPTION OF THE PRIOR ART

As is well known, the vuilleumier heat pump is provided with two cylinders charged with helium or hydrogen gas, and high temperature and low temperature displacers arranged within each of the cylinders which perform a reciprocating motion out of phase from each other so that the gas charged in each of the cylinders by the reciprocation of the high temperature and low temperature gas displacers is periodically circulated to the heat exchanger and the regenerator, both of which communicate with each of the cylinders, whereby space heating, space cooling, and hot water generating processes can be accomplished by the heat absorption and heat discharging characteristics of the gas in the heat exchanger.

More specifically, as shown in FIG. 2, a conventional vuilleumier heat pump (P) comprises high temperature and low temperature cylinders 100 and 200 arranged approximately at right angles to each other, gas displacers 110 and 210 provided within the cylinders 100 and 200, respectively, for performing a reciprocating motion out of phase from each other, a high temperature heat exchanger 120 communicating with a high temperature chamber 101 of the cylinder 100 and heated by an external burner 300, a high temperature gas regenerator 140 and a medium temperature heat exchanger 130 arranged in series with the high temperature heat exchanger 120 and communicating with a first medium temperature chamber 102 of the high temperature cylinder 100, a low temperature heat exchanger 220 communicating with a low temperature chamber 201 of the low temperature cylinder 200, and a low temperature regenerator 240 and medium temperature heat exchanger 230 arranged in series with the low temperature heat exchanger 220 and communicating with a second medium temperature chamber 202 of the low temperature cylinder 200.

In such a vuilleumier heat pump, high temperature heat generated in the high temperature cylinder 100 is absorbed and transferred by the fluid medium circulating through the indoor heat exchanger or the hot water heat exchanger, thereby performing the space heating and hot water generating cycles. Also, low temperature heat generated in the low temperature cylinder 200 is absorbed and transferred by the fluid medium circulating through the indoor heat exchanger or the low temperature heat exchanger, thereby enabling the space cooling or refrigerating cycle.

A typical vuilleumier heat pump system is disclosed in Japanese Patent Specification No. H4-24474 A, published on Jan. 28, 1992, and is shown in the attached drawing FIG. 2 as a reference. In the drawing, the above vuilleumier heat pump system incorporates six fluid control valves 24, 25, 27, 29, 33, and 36, and this system is configured to circulate the fluid medium from the medium temperature heat exchanger 130 in the heating side selectively through the indoor heat exchanger 23, hot water heat exchanger 35, outdoor heat exchanger 28 for radiating heat, and the medium temperature heat exchanger 230 in the cooling side and back to the medium temperature heat exchanger 130 of heating side. The fluid medium from the low temperature heat exchanger 220 is circulated selectively through the refrigerating heat exchanger 32, the indoor heat exchanger 23, and the outdoor heat exchanger 31 in order to absorb heat and then returned to the low temperature heat exchanger 220.

The above described circulation is accomplished by a high temperature side circulating pump 30 provided at the inlet of the medium temperature heat exchanger 230 in the cooling side, and by a low temperature side circulating pump 26 provided at the outlet of the low temperature heat exchanger 220.

When the system is operated in the cooling mode, the six control valves 24, 25, 27, 29, 33, and 36 are actuated in order to circulate the direction of flow as shown by the solid line arrows. Then, the low temperature fluid medium from the low temperature heat exchanger 220 is circulated through the loop consisting of the low temperature side circulating pump 26, the fifth valve 33, the second valve 25, the indoor heat exchanger 23, the third valve 27, and the low temperature heat exchanger 220, thereby performing the space cooling mode by the indoor heat exchanger 23.

Meanwhile, the hot fluid medium from the medium temperature heat exchanger 130 in the high temperature side is circulated through the loop consisting of the first valve 24, the sixth valve 36, the outdoor heat exchanger 28 performing as a heat sink, the fourth valve 29, the high temperature side circulating pump 30, and the medium temperature heat exchanger 230 in the cooling side.

In the heating mode, the first to fourth valves 24, 25, 27, and 29 are actuated to change the direction of flow of the fluid medium as shown by the dashed line arrows, while the fifth valve maintains its flow direction shown by the solid line arrow. Then, the hot fluid medium from the medium temperature heat exchanger 130 in the high temperature side is circulated through the loop consisting of the first valve 24, the second valve 25, the indoor heat exchanger 23, the fourth valve 29, the high temperature side circulating pump 30, and the medium temperature heat exchanger 230 in the cooling side, thereby performing the space heating function by the indoor heat exchanger 23.

Meanwhile, the cool fluid medium from the low temperature heat exchanger 220 is circulated by the low temperature side circulating pump 26 through the fifth valve 33, the outdoor heat exchanger 31, the third valve 27, and the low temperature heat exchanger 220, whereby the absorption heat from the outside air is performed by the outdoor heat exchanger 31.

Further, in the water heating mode, the hot fluid medium from the medium temperature heat exchanger 130 in the high temperature side is circulated through the loop consisting of the first valve 24, the sixth valve 36, the hot water heat exchanger 35, the high temperature side circulating pump 30, and the medium temperature heat exchanger 230 in the cooling side, thereby heating the water in the tank 37 by the hot water heat exchanger 35.

In addition to the above described operations, the heat pump system performs various operations such as simultaneous operation of heating and refrigerating, and complex operations of heating, hot water generating and refrigerating by manipulating the above flow direction switching valves 24, 25, 27, 29, 33, and 36.

However, the heat pump system described above can not continuously perform a hot water generating operation during other operation modes. That is, when hot water is required during the cooling or heating operation mode, a manipulation of the valves is necessary to generate hot water, thereby requiring additional time to heat the water which imposes an inconvenience by causing the user to wait for the desired hot water.

Furthermore, because the cooling and heating operation is performed by one fan coil type heat exchanger, space heating is disadvantageously limited to only one air heating mode. Also, as shown in FIG. 2, since the conduit circuit has a complicated structure, it is difficult to install and maintain the conduits and materials.

SUMMARY OF THE INVENTION

The present invention is intended to overcome the above described disadvantages inherent in the conventional techniques.

Therefore, it is an object of the present invention to provide a cooling and heating system using a vuilleumier heat pump which is capable of continuously generating hot water during the cooling and heating modes in order to provide hot water in either the hot water generating or the cooling and heating operation modes.

Another object of the present invention is to provide a vuilleumier heat pump system having two separate indoor heat exchangers for use in both the cooling and heating modes, so that the heating mode heat exchanger can be one of various types other than the fan heater type of unit.

Another object of the present invention is to provide a vuilleumier heat pump system which is of a relatively simple design in order to arrange conduits for easy installation, manipulation, and maintenance.

In achieving the above objects, the present invention is incorporated in a cooling and heating system using a vuilleumier heat pump including a plurality of flow direction control valves, a hot water generating heat exchanger, indoor and outdoor heat exchangers for space heating and space cooling, characterized in that the conduit circuit is configured such that the high temperature fluid medium from the medium temperature heat exchanger of the high temperature side of the vuilleumier heat pump is circulated by a high temperature side circulating pump through the hot water generating heat exchanger even during the a cooling or heating operation mode, whereby the hot water generating operation can be carried out during the space cooling or space heating mode.

Preferably, the indoor heat exchanger is comprised of two separate indoor heat exchangers for use in both the cooling and heating modes so that the heating mode heat exchanger can be one of various types other than the fan heater type of unit.

Also, the hot water generating heat exchanger is disposed between said high temperature side circulating pump and said indoor heat exchanger.

Further, the present invention is incorporated in a cooling and heating system using a vuilleumier heat pump including a medium temperature heat exchanger in the high temperature side and a medium temperature heat exchanger in the low temperature side which interconnect with a hot water generating heat exchanger, an indoor heat exchanger for space heating and space cooling, an outdoor heat exchanger, a high temperature side circulating pump, and a low temperature side circulating pump, comprising: a first fluid circulating loop for directing a hot fluid medium from the medium temperature heat exchanger in the high temperature side of the vuilleumier heat pump, in the heating mode, to the high temperature side circulating pump, the hot water generating heat exchanger, the heat exchanger for heating and the medium temperature heat exchanger in the low temperature side; a second fluid circulating loop for directing a hot fluid medium from the medium temperature heat exchanger in the high temperature side of the vuilleumier heat pump, in a cooling mode, to the high temperature side circulating pump, the hot water generating heat exchanger, the outdoor heat exchanger, and the medium temperature heat exchanger in the low temperature side; and a third fluid circulating loop for directing hot fluid medium from the medium temperature heat exchanger in the high temperature side of the vuilleumier heat pump, in a hot water generating mode, to the high temperature side circulating pump, the hot water generating heat exchanger, and the medium temperature heat exchanger in the low temperature side and then back to the medium temperature heat exchanger in the high temperature side.

BRIEF DESCRIPTION OF THE DRAWINGS

The above object and other advantages of the present invention will become more apparent by describing in detail the preferred embodiment of the present invention with reference to the attached drawings in which.

DETAILED DESCRIPTION OF THE PREFERRED EMBODIMENT

Figure 1:
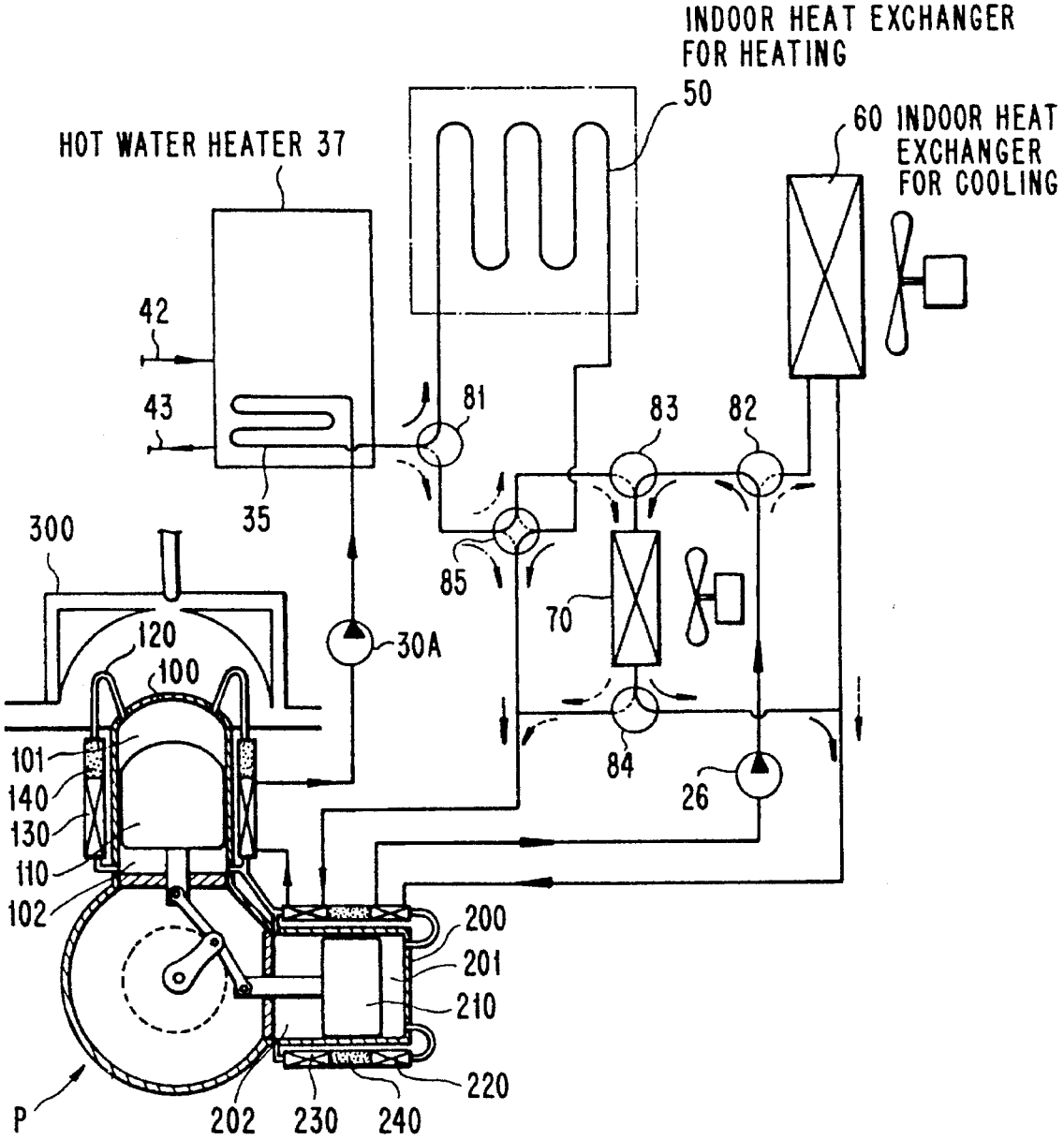
FIG. 1 is a schematic flow diagram of a vuilleumier heat pump system in accordance with the present invention.
Figure 2:
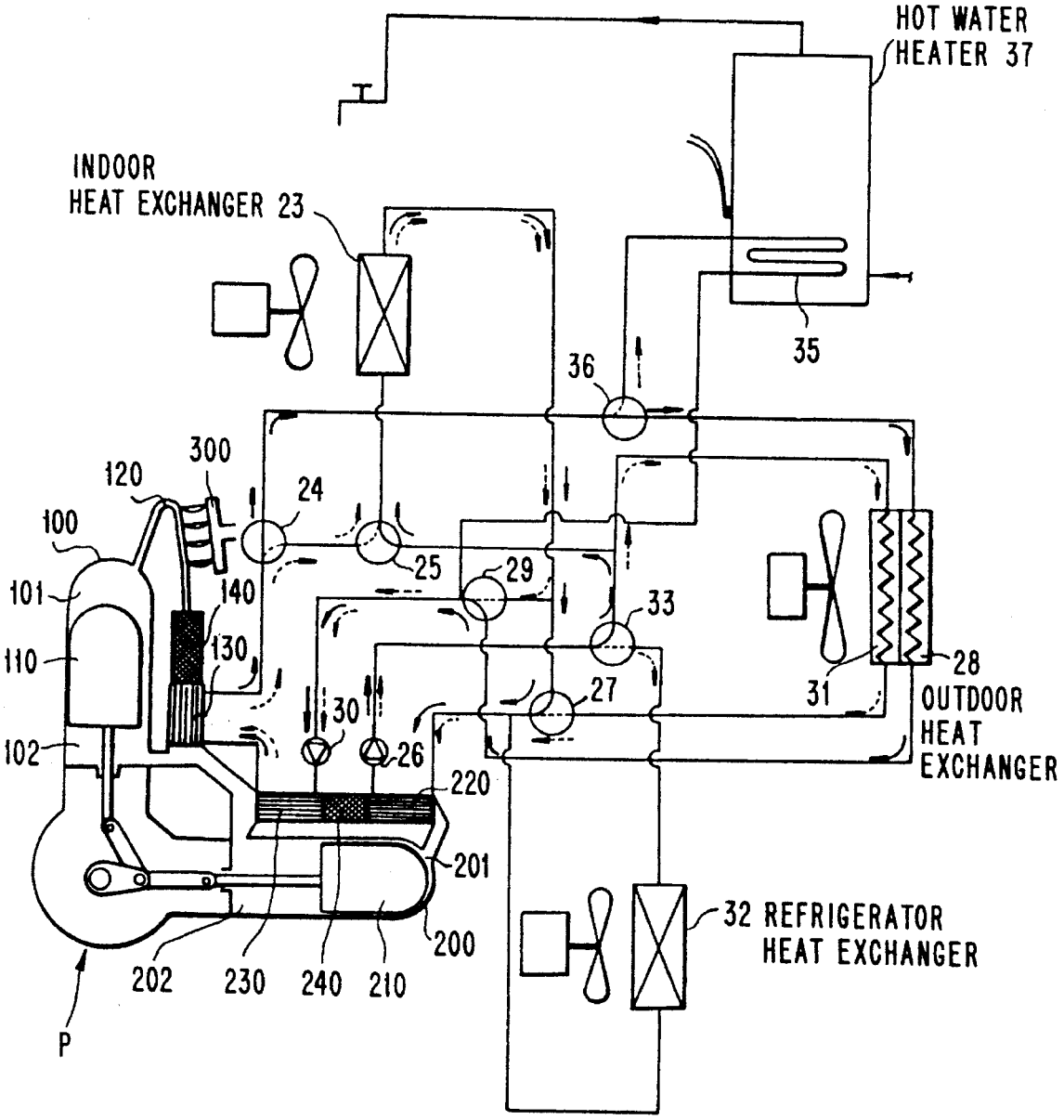
FIG. 2 (PRIOR ART)
FIG. 2 is a schematic flow diagram of a conventional vuilleumier heat pump system.

Referring to FIG. 1, a preferred embodiment of the cooling and heating system using vuilleumier heat pump, according to this invention is shown. The vuilleumier heat pump (P) in FIG. 1 is the same as the conventional pump in FIG. 2, and therefore a description thereof will be omitted. Also, throughout the drawings, the same or equivalent components constituting the system are denoted by the same reference numerals.

As shown in detail in FIG. 1, the cooling and heating system of this invention includes a high temperature side circulating pump 30A provided adjacent to the vuilleumier heat pump(P), a low temperature side circulating pump 26, a heat exchanger 35 for generating hot water, an indoor heat exchanger 50 for space heating, an indoor heat exchanger 60 for space cooling, an outdoor heat exchanger 70, and a plurality of switching valves 81, 82, 83, 84, and 85.

The high temperature side circulating pump 30A circulates a hot fluid medium from the medium temperature heat exchanger 130 of the high temperature side of the vuilleumier heat pump(P) by the conduits through the hot water heat exchanger 35, and either the space heating indoor heat exchanger 50, or the outdoor heat exchanger 70. Also, the low temperature side circulating pump 26 circulates a cool fluid medium from the low temperature heat exchanger 220 of the vuilleumier heat pump(P) through either the space cooling indoor heat exchanger 50 or the outdoor heat exchanger 70.

Preferably, the space heating indoor heat exchanger 50 is configured such that a plurality of heat transfer pipes are arranged laterally at predetermined intervals and disposed under the floor of the room to be heated, suitable to be adapted to the floor heating style prevailing in northeast Asian countries including Korea (the so called 'Ondol' heating mode), so that space heating is performed by radiation of heat from under the floor through the heat transfer pipes.

The space cooling indoor heat exchanger 60 is of the conventional fan coil type which generally cools the room air. Also, the outdoor heat exchanger 70 absorbs heat from the hot fluid medium and transfers heat to the low fluid medium.

Further, the switching valves 81, 82, 83, 84, and 85 are actuated to control the direction of flow of the high and low temperature fluid medium in order to change operations among the space heating, space cooling, and hot water generating function.

The operation and effect of the cooling and heating system of the present invention will be apparent from the following description with reference to FIG. 1.

When the system of the invention is operated in the heating mode, the valves 81, 82, 83, 84, and 85 are actuated to circulate the fluid medium as shown by the solid line arrows. Thus, the hot fluid medium from the medium temperature heat exchanger 130 of the high temperature side of the vuilleumier heat pump(P) is circulated by the high temperature side circulating pump 30A through the hot water heat exchanger 35, the valve 81, the space heating indoor heat exchanger 50, and the valve 85 and through the medium temperature heat exchanger 230 in the cooling side and back to the medium temperature heat exchanger 130. Also, the cool fluid medium from the low temperature heat exchanger 220 is circulated by the low temperature side circulating pump 26 through the valve 82, the outdoor heat exchanger 70, and the valve 84 and back to the low temperature heat exchanger 220.

In this heating mode, hot water generating and space heating can be performed by heating the water reserved in tank 37 and heating the floor through the indoor heat exchanger 50, respectively. Therefore, during the heating operation, the water generating operation can be carried out by heating water in the tank 37.

When the system operates in the cooling mode, the valves 81, 82, 83, 84, and 85 are actuated to change the direction of flow of the fluid medium as shown by the dotted line arrows. Thus, a hot fluid medium from the medium temperature heat exchanger 130 in the high temperature side of the vuilleumier heat pump(P) is circulated by the high temperature side circulating pump 30A through the hot water heat exchanger 35, the valves 81, 85, and 83, the outdoor heat exchanger 70, and the valve 84 and through the medium temperature heat exchanger 230 in the cooling side and back to the medium temperature heat exchanger 130. Also, a cool fluid medium from the low temperature heat exchanger 220 is circulated by the low temperature side circulating pump 26 through the valve 82, and the space cooling heat exchanger 60 and back to the low temperature heat exchanger 220.

In this cooling mode, the space cooling operation can be performed by removing the heat extracted from the room air by means of the outdoor heat exchanger 70, while hot water generating is carried out by heating water in the tank 37 through the hot water heat exchanger 35.

When the system is operated solely in a hot water generating mode, the valve 81 is actuated to turn the direction of flow of the fluid medium as shown by the dotted line arrow. Similarly, the valves 82, 83, and 84 are actuated to turn the direction of flow of the fluid medium as shown by the solid line arrows, and the valve 85 is actuated to turn the direction of flow of the fluid medium as shown by the dashed line arrow. Thus, hot fluid medium from the medium temperature heat exchanger 130 in the high temperature side of the vuilleumier heat pump(P) is circulated by the high temperature side circulating pump 30 through the hot water heat exchanger 35, the valves 81 and 85, and the medium temperature heat exchanger 230 in the low temperature side and back to the medium temperature heat exchanger 130 in the high temperature side. Further, a cool fluid medium from the low temperature heat exchanger 220 is circulated by the low temperature side circulating pump 26 through the valve 82, the valve 83, the outdoor heat exchanger 70, and the valve 84 and then back to the low temperature heat exchanger 220.

In this hot water generating mode, since a hot fluid medium from the medium temperature heat exchanger 130 in the high temperature side is circulated directly through the hot water heat exchanger 35, and the medium temperature heat exchanger 230 in the low temperature side and back to the medium temperature heat exchanger 130 of high temperature side, the immediate transfer of heat is possible in the hot water heat exchanger 35, thereby quickly heating the water reserved in the tank 37. Here, the tank 37 containing the hot water heat exchanger 35 is provided with a reserve water supply line 42 in order to fill up water to the predetermined level. Also, a hot water discharging line 43 is provided for drawing hot water out of the tank.

As is apparent from the foregoing description, the cooling and heating system according to the invention allows a hot fluid medium from the medium temperature heat exchanger in the high temperature side of the vuilleumier heat pump(P) to be continuously circulated by the high temperature side circulating pump 30 through the hot water heat exchanger 35 during the hot water generating mode as well as in the cooling or heating operation mode, and thereby supplying hot water even in the space cooling or space heating mode.

Further, because the cooling and heating system according to the invention utilizes a separate indoor heat exchanger for use in both the cooling and heating modes, the heat exchanger for the heating space can be configured in various exchanger forms other than the fan heater type, preferably for use in the 'Ondol' heating mode in which a plurality of heat transfer pipes are arranged laterally at predetermined intervals and disposed under the floor of the room to be heated.

Further, the arrangement of the conduit circuit in the cooling and heating system according to this invention is considerably simple relative to the prior art and advantageous because it is easy to install, manipulate, and maintain.

What is claimed is:

1. In a method of operating a cooling and heating system comprising a hot water tank having a hot water heat exchanger; indoor heat exchanging means; outdoor heat exchanging means; and a vuilleumier heat pump having high and low temperature sides; wherein during a heating mode a fluid medium is circulated from the high temperature side of the heat pump, through the indoor heat exchanging means, and back to the high temperature side of the heat pump; and during a cooling mode a fluid medium is circulated from the low temperature side of the heat pump, through the indoor heat exchanging means, and back to the low temperature side of the heat pump; the improvement wherein:

during each of the heating and cooling modes, a fluid medium is circulated from the high temperature side of the heat pump through the hot water heat exchanger.

2. The method according to claim 1, wherein the improvement further comprises circulating fluid medium through a first heat exchanger of the indoor heat exchanging means during the heating mode, and circulating fluid medium through a second heat exchanger of the indoor heat exchanging means during the cooling mode.

3. The method according to claim 1, wherein the improvement further comprises circulating fluid medium through a floor-mounted heat exchanger of the indoor heat exchanging means during the heating mode, and circulating fluid medium through a fan coil heat exchanger of the indoor heat exchanging means during the cooling mode.

4. The method according to claim 1, wherein during the heating mode the fluid medium is circulated through the hot water heat exchanger before being circulated through the indoor heat exchanging means.

5. A cooling and heating system comprising:

a hot water tank having a hot water heat exchanger;

indoor heat exchanging means;

outdoor heat exchanging means;

a vuilleumier heat pump having high and low temperature sides;

a first circulating loop circulating a fluid medium from the high temperature side of the heat pump through both the hot water heat exchanger and the indoor heat exchanging means during a heating mode; and a second circulating loop circulating a fluid medium from the high temperature side of the heat pump through the hot water heat exchanger while simultaneously circulating a fluid medium from the low temperature side of the heat pump through the indoor heating exchanging means during a cooling mode.

6. The cooling and heating system according to claim 5, wherein the indoor heat exchanging means includes first and second separate indoor heat exchangers, said first circulating loop comprising means for circulating a fluid medium from the high temperature side of the heat pump through both the hot water heat exchanger and the first indoor heat exchanger during the heating mode; and the second circulating loop comprising means for circulating a fluid medium from the high temperature side of the heat pump through the hot water heat exchanger while simultaneously circulating a fluid medium from the low temperature side of the heat pump through the second indoor heat exchanger during the cooling mode.

7. The cooling and heating system according to claim 6, further including a third circulating loop for circulating fluid medium from the high temperature side of the heat pump to the hot water heat exchanger and then back to the heat pump during a hot water heating mode.

8. The cooling and heating system according to claim 6, wherein the first heat exchanger comprises a floor-mounted heat exchanger, and the second heat exchanger comprises a fan coil heat exchanger.

9. A cooling and heating system comprising:

a hot water tank having a hot water heat exchanger;

indoor heat exchanging means;

outdoor heat exchanging means;

a vuilleumier heat pump having high and low temperature sides;

a first circulating loop for circulating hot fluid medium between: a medium temperature heat exchanger in the high temperature side of the heat pump, the hot water heat exchanger and the indoor heat exchanging means, and a medium temperature heat exchanger in the low temperature side of the heat pump, during a heating mode;

a second circulating loop for circulating hot fluid medium between: the medium temperature heat exchanger in the high temperature side of the heat pump, the hot water heat exchanger, the outdoor heat exchanging means and the medium temperature heat exchanger in the low temperature side of the heat pump, during a cooling mode; and a third circulating loop for circulating hot fluid medium between: the medium temperature heat exchanger in the high temperature side of the heat pump, the hot water heat exchanger, and the medium temperature heat exchanger in the low temperature side of the heat pump, during a hot water generating mode.

* * * * *